US009909470B2

(12) United States Patent
Christian et al.

(10) Patent No.: US 9,909,470 B2
(45) Date of Patent: Mar. 6, 2018

(54) CRANKCASE VENTILATION PRESSURE MANAGEMENT FOR TURBOCHARGED ENGINE

(71) Applicant: FORD GLOBAL TECHNOLOGIES, LLC, Dearborn, MI (US)

(72) Inventors: Adam M. Christian, Garden City, MI (US); Christopher W. Newman, Farmington Hills, MI (US); Katherine Jane Randall, Belleville, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 544 days.

(21) Appl. No.: 14/694,118

(22) Filed: Apr. 23, 2015

(65) Prior Publication Data

US 2016/0312686 A1 Oct. 27, 2016

(51) Int. Cl.

| | |
|---|---|
| ***F02B 33/44*** | (2006.01) |
| ***F01M 13/04*** | (2006.01) |
| ***F01M 13/02*** | (2006.01) |
| *F01M 13/00* | (2006.01) |
| *F02B 37/00* | (2006.01) |

(52) U.S. Cl.

CPC ..... *F01M 13/04* (2013.01); *F01M 13/022* (2013.01); *F01M 13/023* (2013.01); *F01M 13/028* (2013.01); *F01M 13/0416* (2013.01); *F01M 2013/0077* (2013.01); *F01M 2013/027* (2013.01); *F02B 37/00* (2013.01)

(58) Field of Classification Search

CPC .... F01M 13/04; F01M 13/022; F01M 13/023; F01M 13/028; F01M 13/0416; F01M 2013/0077; F01M 2013/027

USPC ..... 60/605.1

See application file for complete search history.

(56) References Cited

U.S. PATENT DOCUMENTS

| | | | | |
|---|---|---|---|---|
| 7,025,049 | B2 | 4/2006 | Pietschner | |
| 7,523,748 | B2 * | 4/2009 | Hirano | F01M 13/02 123/572 |
| 7,775,198 | B2 | 8/2010 | Shieh | |
| 8,393,315 | B2 | 3/2013 | Ruppel et al. | |
| 8,695,339 | B2 | 4/2014 | Spix | |

(Continued)

FOREIGN PATENT DOCUMENTS

| | | | |
|---|---|---|---|
| CN | 101608562 | B | 8/2011 |
| DE | 10249720 | A1 | 5/2004 |
| WO | 12010109483 | A2 | 9/2010 |

*Primary Examiner* — Ngoc T Nguyen

(74) *Attorney, Agent, or Firm* — Gregory P. Brown; MacMillan, Sobanski & Todd, LLC

(57) ABSTRACT

A crankcase ventilation system for a turbocharged engine has full bi-directional flow for an idle state and a boosted state. A PCV valve provides air flow from the crankcase to the intake manifold in the idle state. A restriction in a first vent line limits fresh air into the crankcase in the idle state. A PCV bypass permits a one-way flow into the crankcase via a second vent line bypassing the PCV valve in the boosted state. A pressure relief valve in communication with the first vent line is configured to bypass the restriction in the boosted state when a pressure in the crankcase exceeds a threshold pressure. In a preferred embodiment, the PCV bypass is configured to bypass both the PCV valve and a pull separator (i.e., oil separator at the second vent line) in the boosted state.

7 Claims, 4 Drawing Sheets

(56) References Cited

U.S. PATENT DOCUMENTS

| | | | | |
|---|---|---|---|---|
| 2008/0110443 | A1* | 5/2008 | Hirano | F01M 13/021 123/572 |
| 2009/0223498 | A1* | 9/2009 | Shieh | F02M 25/06 123/574 |
| 2010/0313830 | A1* | 12/2010 | Ruppel | F01M 13/022 123/41.86 |
| 2013/0291843 | A1 | 11/2013 | Kitayama et al. | |
| 2013/0340731 | A1 | 12/2013 | Pursifull et al. | |
| 2004/0069399 | A1 | 3/2014 | Eckard et al. | |
| 2014/0076294 | A1 | 3/2014 | Ulrey et al. | |
| 2014/0331979 | A1 | 11/2014 | Valencia | |

* cited by examiner

CRANKCASE VENTILATION PRESSURE MANAGEMENT FOR TURBOCHARGED ENGINE

CROSS REFERENCE TO RELATED APPLICATIONS

Not Applicable.

STATEMENT REGARDING FEDERALLY SPONSORED RESEARCH

Not Applicable.

BACKGROUND OF THE INVENTION

The present invention relates in general to crankcase ventilation for internal combustion engines, and, more specifically, to ventilation of a gasoline engine that employs a turbocharger for compressing the intake air at high engine loads.

Gases accumulate in an engine crankcase when gases from engine cylinders bypass engine pistons and enter the crankcase during engine rotation. These gases are commonly referred to as blowby gases. The blowby gases can be combusted within engine cylinders to reduce engine hydrocarbon emissions using a positive crankcase ventilation (PCV) system which returns the blowby gases to the engine air intake and combusting the gases with a fresh air-fuel mixture. Combusting crankcase gases via the engine cylinders may require a motive force to move the crankcase gases from the engine crankcase to the engine air intake. One conventional way to provide motive force to move crankcase gases into the engine cylinders is to provide a conduit between the crankcase and a low pressure region (e.g., vacuum) of the engine intake manifold downstream of an engine throttle body. In addition, fresh air from a point upstream of the throttle body is added to the crankcase via a separate conduit (i.e., breather) to help flush the blowby products from the crankcase and into the intake manifold.

Use of turbocharging with combustion engines is becoming increasingly prevalent. In an exhaust-gas turbocharger, for example, a compressor and a turbine are arranged on the same shaft (called a charger shaft) wherein a hot exhaust-gas flow supplied to the turbine expands within the turbine to release energy and cause the charger shaft to rotate. The charger shaft drives a compressor which is likewise arranged on the charger shaft. The compressor is connected in an air inlet duct between an air induction and filtering system and the engine intake manifold so that when the turbocharger is activated, the charge air supplied to the intake manifold and engine cylinders is compressed.

Turbocharging increases the power of the internal combustion engine because a greater air mass is supplied to each cylinder. The fuel mass and the mean effective pressure are increased, thus improving volumetric power output. Accordingly, the engine displacement used for any particular vehicle can be downsized in order to operate with increased efficiency and reduced fuel use, wherein the turbocharger is inactive during times of low power requirements and is activated during times of high load, such as wide open throttle (WOT). In addition to reduced fuel consumption, turbocharging has a beneficial effect of reducing emissions of carbon dioxide and pollutants.

Due to the increased pressure at the intake manifold during high load operation which results from compressing the inlet air by the turbocharger compressor, modifications to the conventional crankcase ventilation system are necessary. In particular, the high pressure introduced downstream of the compressor (e.g., in the intake manifold) could reverse the flow in the vent line thereby pressurizing the crankcase to an extent that could cause failure of the seals. To prevent such a reversal, a check valve is usually placed in that vent line. To avoid a buildup of blowby gas in the crankcase, the flow is allowed to reverse in the other vent line (i.e., the breather that otherwise supplies fresh air from a point upstream of the throttle body and turbocharger compressor into the crankcase). Thus, any pressure buildup in the crankcase that could damage the seals is prevented.

During engine idling when a large vacuum is present at the intake manifold, it is desirable to maintain a negative pressure in the crankcase. To ensure a negative crankcase pressure at idle on a boosted gas (i.e., turbocharged) engine, it is often necessary to restrict the fresh air feed to the crankcase. An appropriately sized restriction in the corresponding breather vent line is used to accomplish this. However, if the crankcase fresh air feed is restricted too much then the crankcase may become positively pressurized under full load conditions (i.e., when the restricted vent line or breather reverses flow to evacuate the blowby gases into the low pressure section of the air inlet system), which can jeopardize the crankcase sealing integrity. It is often difficult or impossible to find a restriction level that provides the needed vacuum at idle while not creating an undesirably large positive pressure during full load operation.

Copending U.S. application Ser. No. 14/525,554, filed Oct. 28, 2014, entitled "Crankcase Ventilation for Turbocharged Engine," incorporated herein by reference, discloses a dual-acting valve having a first flow capacity into the crankcase and a second flow capacity out from the crankcase which is greater than the first flow capacity. The dual-acting valve provides the desired restriction when the engine is in an idle state and provides a greater flow when the engine is in a boosted state (i.e., when the turbocharger pressurizes the intake manifold) to avoid over-pressurization of the crankcase. In such a system, however, undiluted blowby gases are collected to be ingested by the engine. Oil degradation such as sludging, varnishing, and emulsification can occur due to insufficient fresh air being mixed with the blowby gases in the crankcase prior to reaching the oil separator. Undiluted blowby gases may accumulate high levels of unburned fuel, such as during a decel fuel cutoff, which may increase pollution or cause other problems.

SUMMARY OF THE INVENTION

The present invention employs a PCV bypass which is sized to permit an appropriate flow of pressurized air during a boosted state from the intake manifold into the crankcase for diluting the blowby gases. The flow control components are arranged in a way that enables independent sizing of components and the ability to obtain desirable crankcase pressure under all operating conditions.

In one aspect of the invention, a vehicle comprises an internal combustion engine with an intake manifold receiving fresh air via an inlet duct, wherein the engine includes a crankcase. A turbocharger has a compressor with an inlet coupled to the inlet duct and an outlet coupled to the intake manifold, wherein the engine and turbocharger have an idle state and a boosted state. A first vent line communicates between the crankcase and the compressor inlet. A second vent line communicates between the crankcase and the intake manifold. A PCV valve in communication with the second vent line is responsive to a vacuum pressure in the intake manifold to allow air flow from the crankcase to the intake manifold in the idle state. A restriction in communication with the first vent line is configured to limit a flow of fresh air via the first vent line into the crankcase in the idle state. A PCV bypass is configured to permit a one-way flow into the crankcase via the second vent line bypassing the PCV valve in the boosted state. A pressure relief valve in communication with the first vent line is configured to bypass the restriction in the boosted state when a pressure in the crankcase exceeds a threshold pressure. In a preferred embodiment, the PCV bypass is configured to bypass both the PCV valve and a pull separator (i.e., oil separator at the second vent line) in the boosted state.

DETAILED DESCRIPTION OF PREFERRED EMBODIMENTS

Figure 1:
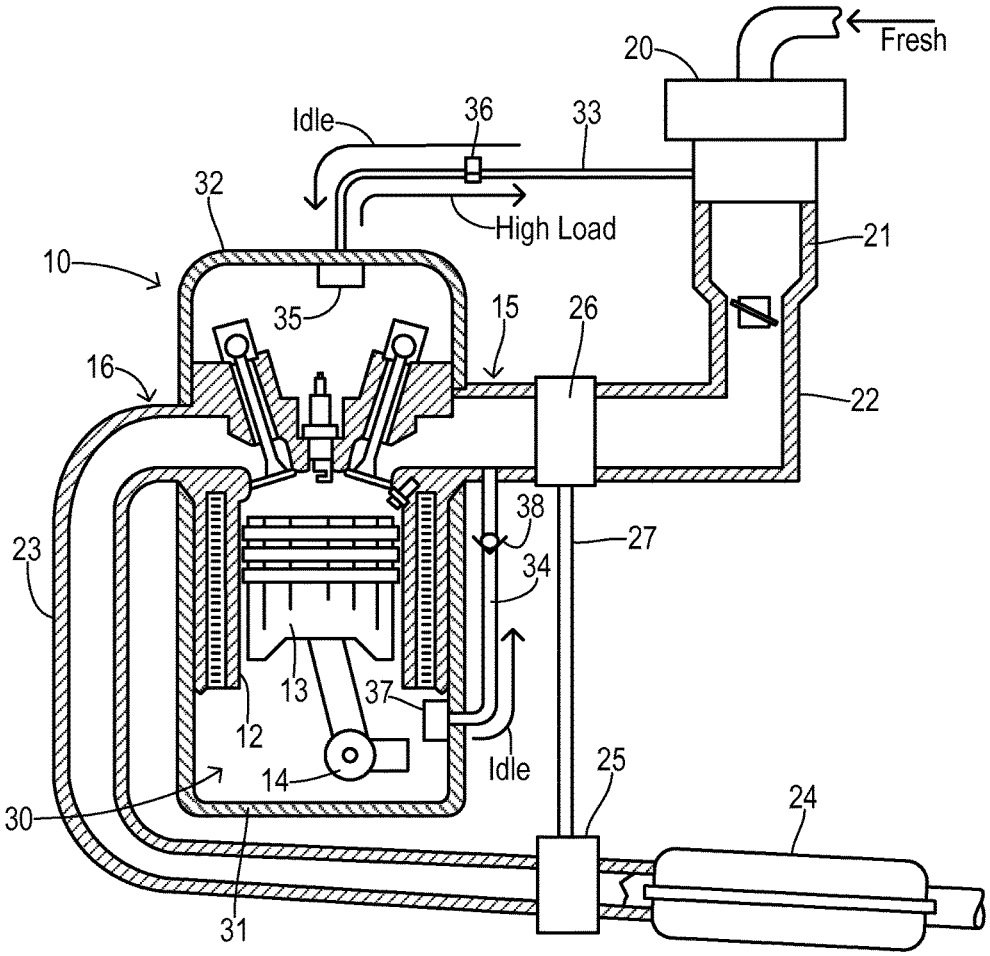
Fig. 1 (Prior Art)
FIG. 1 depicts a turbocharged internal combustion engine with a conventional crankcase ventilation arrangement.

Referring to FIG. 1, an internal combustion engine 10 in an automotive vehicle includes a plurality of cylinders. One cylinder is shown, which includes a combustion chamber 11 and cylinder walls 12 with piston 13 positioned therein and connected to crankshaft 14. Combustion chamber 11 communicates with an intake manifold 15 and exhaust manifold 16 via respective intake and exhaust valves operated by respective cams.

Engine 10 may preferably utilize direct fuel injection and an electronic distributorless ignition system as known in the art. Fresh outside air is conducted to engine 10 via an air filter 20, a throttle body 21, and an air inlet duct 22 connected to intake manifold 15. Combustion products exiting exhaust manifold 16 are conducted via a conduit 23 to a catalytic converter 24 on their way to an exhaust system (not shown). A turbocharging system is comprised of a turbine 25 positioned in the exhaust gas flow before catalytic converter 24 and coupled to a compressor 26 by a driveshaft 27. Exhaust gases passing through turbine 25 drive a rotor assembly which in turn rotates driveshaft 27. In turn, driveshaft 27 rotates an impeller included in compressor 26 thereby increasing the density of the air delivered to combustion chamber 11. In this way, the power output of the engine may be increased. One or more bypass valves (such as a wastegate) may be provided for turbine 25 and/or compressor 26 that are controlled in a desired manner to activate or deactivate turbocharging according to engine loading.

Crankcase 30 refers to a crankcase volume that may be defined in part by an oil pan 31 and a cam cover 32, for example. When an air-fuel mixture is combusted in engine combustion chamber 11, a small portion of combusted gas may enter crankcase 30 through the piston rings. This gas is referred to as blowby gas. To prevent this untreated gas from being directly vented into the atmosphere, a positive crankcase ventilation (PCV) system is utilized which includes a first vent line (breather) 33 and a second vent line 34. First vent line 33 is coupled between cam cover 32 and the low pressure side of compressor 26 such as at throttle body 21 (or alternatively at any other position along air inlet duct 22). Second vent line 34 is connected to crankcase 30 near oil pan 31 and to the high pressure side of compressor 26 (e.g., to intake manifold 15). Oil separators 35 and 37 are preferably included at the connections of vent lines 33 and 34 to crankcase 30 to remove entrained oil from any gases being returned to the engine air intake.

During engine idling and low load conditions when turbocharger compressor 26 is not activated, a vacuum pressure in intake manifold 15 causes a crankcase ventilation flow in which fresh air enters crankcase 30 via first vent line 33 and leaves crankcase 30 via second vent line 34. A one-way check valve 38 (e.g., a conventional PCV valve) in second vent line 34 allows flow in this direction. A restriction 36 in first vent line 36 has a size (i.e., flow capacity) that limits the amount of fresh air allowed to enter crankcase 30, wherein the flow capacity is selected to maintain a desired vacuum pressure in crankcase 30 during the idle state. When compressor 26 is activated during a high load condition such as wide-open throttle, pressure in intake manifold 15 increases to a pressure higher than the pressure in crankcase 30. Reverse flow in second vent line 34 is blocked by check valve 38. Excessive accumulation of blowby gas in crankcase 30 is avoided by allowing a reverse flow in first vent line 33. The sizing of restriction 36 has been a tradeoff between the desire to have a sufficiently small flow capacity during idle to maintain a desirable negative pressure in crankcase 30 (which would be lost if an unlimited amount of fresh air could enter via first vent line 33) and a desire to have a sufficiently large flow capacity during high engine load so that a high pressure buildup in crankcase 30 is avoided. As stated above, the lack of fresh air supply to the crankcase can lead to oil degradation and other issues.

Figure 2:
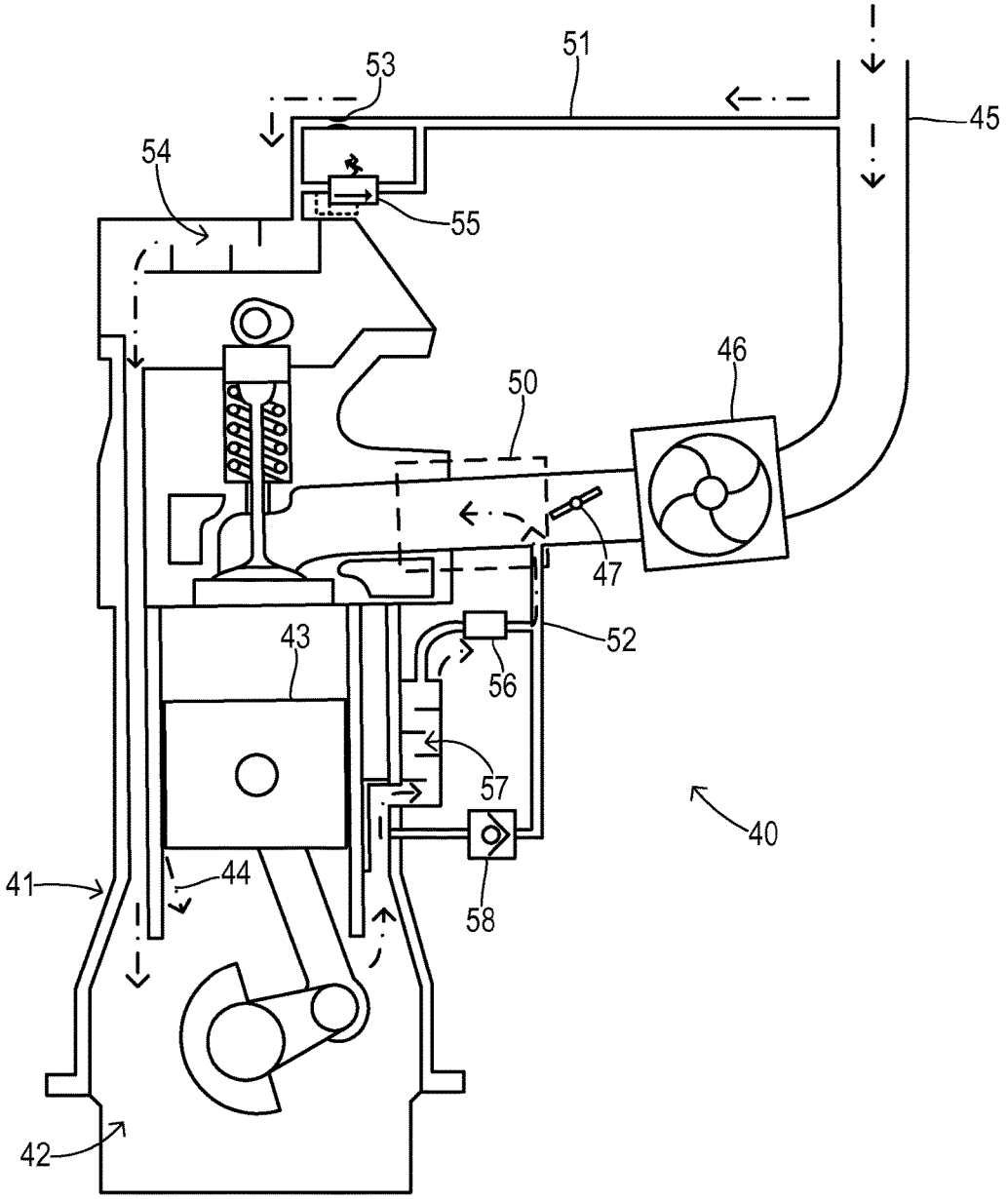
FIG. 2 depicts an improved ventilation system of the present invention with flow indicated during an idle state.

The invention introduces a supply of fresh air for ventilating a crankcase under all conditions, including an idle state and a boost state, for a vehicle system 40 shown in FIG. 2. An engine 41 includes a crankcase 42 which accumulates blowby gases 44 which enter crankcase 42 bypassing piston 43. Fresh air enters inlet duct 45 and passes through a turbocharger compressor 46 past throttle 47 and into intake manifold 50.

A first vent line 51 communicates between crankcase 42 and inlet duct 45 via a push oil-air separator 54 and a restriction 53. A pressure relief valve 55 is placed in parallel with restriction 53 between first vent line 51 and push separator 54. A second vent line 52 is communicates between intake manifold 50 and crankcase 42 via a PCV valve 56 and a pull oil separator 57. A PCV bypass 58 is configured to permit one-way flow into crankcase 42 via second vent line 52 bypassing PCV valve 56 in the boosted state. In a preferred embodiment, PCV bypass 58 also bypasses pull separator 57 which would otherwise introduce a large pressure drop that the relatively high flow rates seen under the boosted state.

FIG. 2 shows PCV flow in the idle state of engine 41 which is driven by vacuum pressure in intake manifold 50. Thus, fresh air flows via first vent line 51 through restriction 53 and push separator 54 into crankcase 42 for mixing with blowby gases 44. The mixture flows through pull separator 57 and PCV valve 46 into intake manifold 50 for ingestion by engine 41. The flow capacities for restriction 53, pull separator 57, and PCV valve 56 can be tailored for the idle state without making any significant trade-offs for the flow requirements for the boosted state.

Figure 3:
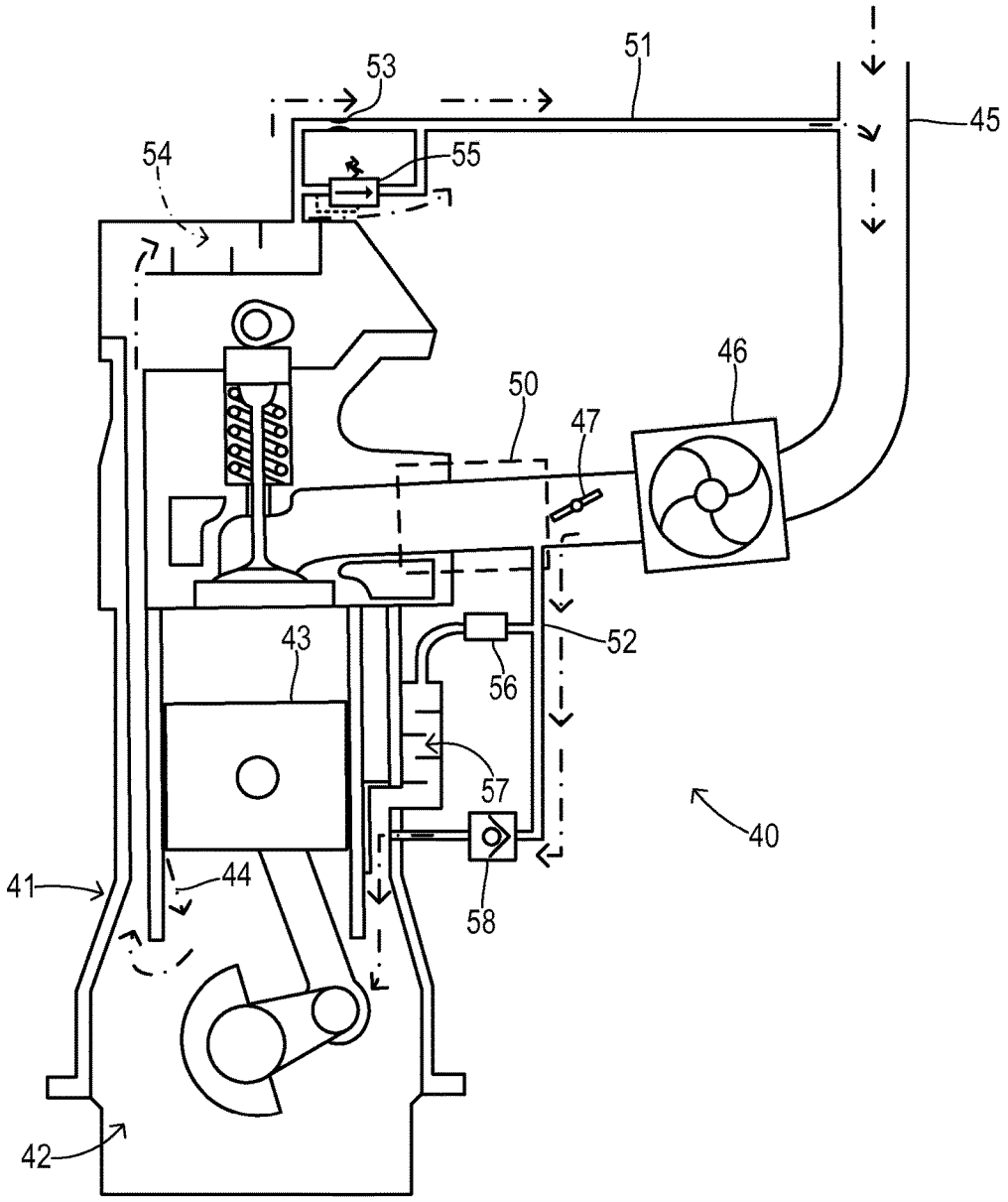
FIG. 3 depicts an improved ventilation system of the present invention with flow indicated during a boosted state.

In the boosted state shown in FIG. 3, increased pressure in the intake manifold 50 drives a flow of fresh air via second vent line 52 through PCV bypass 58 and into crankcase 42. The fresh air mixes with blowby gases 44, and the mixture is extracted via push separator 54 into first vent line 51 and inlet duct 45. As pressure in crankcase 42 initially rises above atmospheric pressure, the mixture flows through restriction 53. As pressure in crankcase 42 builds further, pressure relief valve 55 opens to provide a bypass around restriction 53, thereby limiting the positive pressure in crankcase 42. In one preferred embodiment, pressure relief valve 55 is activated at a crankcase pressure of about 2.5 kPa. Relief valve 55 may be activated not only during a boosted state but may also provide a pressure relief in the event of engine backfire. Moreover, the flow capacities for PCV bypass 58, push separator 54, and pressure relief valve 55 can be tailored for the boosted state without making any significant trade-offs for the flow requirements for the idle state. Thus, the invention decouples the two sides of the ventilation system, allowing appropriate specification of the parameters for each system component for its specific purpose and enabling complete control of crankcase pressure under all operating conditions.

Figure 4:
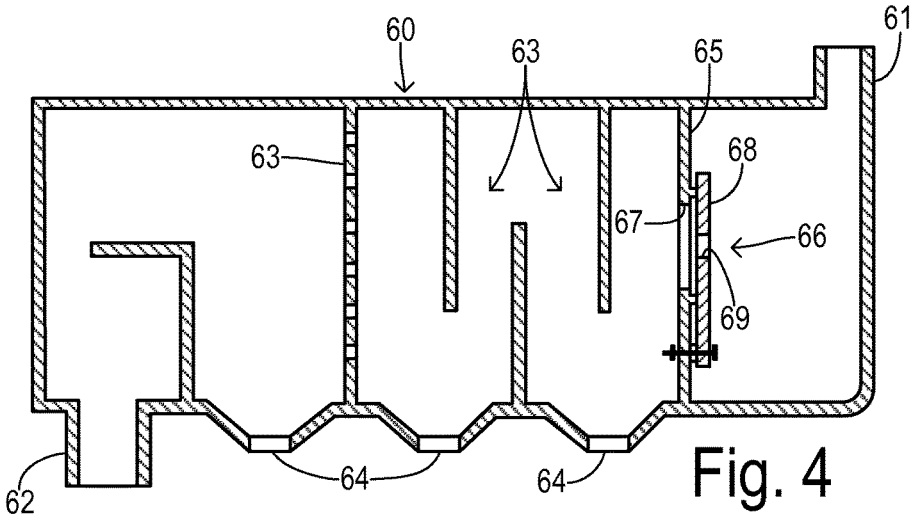
FIG. 4 is cross-sectional views showing one embodiment of a push separator incorporating a flow restriction and a pressure relief.

FIG. 4 shows another embodiment for the restriction and pressure relief components in the first vent line. This embodiment employs a dual-acting valve having a flow capacity which varies depending upon the direction of air flow in order to simultaneously obtain optimized performance for limiting the inflow of fresh air during engine idling and fully venting blowby gas during high engine load. Air-oil separator 60, which may be integrated with a cam cover, includes an inlet 61 for connecting to the first vent line, an outlet 62 for connecting to the crankcase, and plurality of internal baffles 63 which collect oil and return it to the crankcase via drains 64. A sealing wall 65 partitions oil separator 60 into two separate chambers which are selectably coupled by dual-acting valve 66. Valve 66 includes a large opening 68 in sealing wall 65 which is configured to provide a large flow capacity during blowby flow from the crankcase. A movable flap 68 is arranged to cover opening 67 and has a smaller orifice 69 aligned with opening 60 configured to provide a smaller flow capacity for fresh air flowing in the direction into the crankcase. Movable flap 68 is coupled at a pivot point to sealing wall 65 by a fastening pin. Movable flap 68 may preferably be comprised of a flat spring formed of sheet metal or other material that naturally returns to a flat configuration against opening 67 as shown in FIG. 4.

Figure 5:
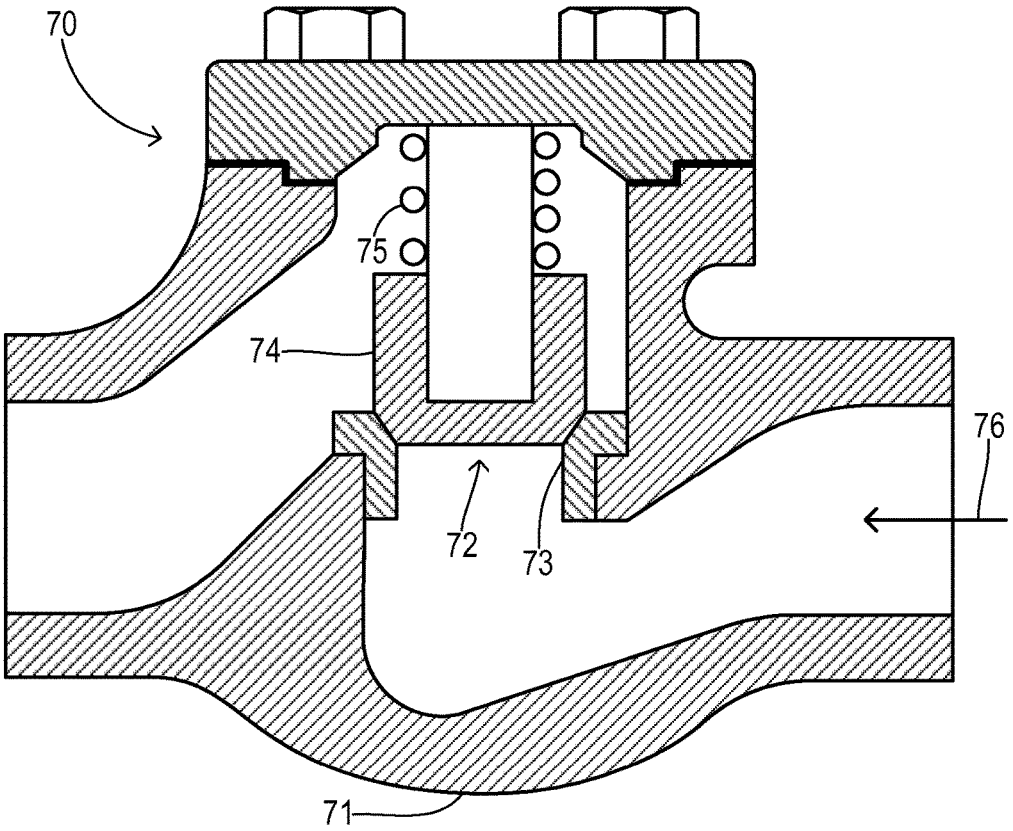
FIG. 5 is a cross-sectional view of one embodiment of a PCV bypass comprising a check valve.

FIG. 5 shows an embodiment of a PCV bypass comprising a check valve 70. A valve body 71 includes an opening 72 with a valve seat 73 for receiving a plunger 74 which is normally disposed against seat 73 by a spring 75. During the boosted state, a reverse PCV flow indicated by arrow 76 lifts plunger 74 off from valve seat 73 to provide a desired flow capacity for providing fresh air into the crankcase. Valve body 71 is adaptable for use as a separate device connected in a vent line or as an integral device formed with a connector, for example.

What is claimed is:

1. A vehicle comprising:

an internal combustion engine with an intake manifold receiving fresh air via an inlet duct, wherein the engine includes a crankcase;

a turbocharger having a compressor with an inlet coupled to the inlet duct and an outlet coupled to the intake manifold, the engine and turbocharger having an idle state and a boosted state;

a first vent line communicating between the crankcase and the inlet duct; and a second vent line communicating between the crankcase and the intake manifold;

a PCV valve in communication with the second vent line responsive to a vacuum pressure in the intake manifold to allow air flow from the crankcase to the intake manifold in the idle state;

a restriction in communication with the first vent line configured to limit a flow of fresh air via the first vent line into the crankcase in the idle state;

a PCV bypass configured to permit a one-way flow into the crankcase via the second vent line bypassing the PCV valve in the boosted state; and a pressure relief valve in communication with the first vent line configured to bypass the restriction in the boosted state when a pressure in the crankcase exceeds a threshold pressure.

2. The vehicle of claim 1 further comprising:

a pull separator in communication with the second vent line; and a push separator in communication with the first vent line;

wherein the PCV bypass is configured to bypass both the PCV valve and the pull separator in the boosted state.

3. The vehicle of claim 1 wherein the PCV bypass is comprised of a check valve.

4. A ventilation system for a crankcase of a combustion engine with a turbocharger, comprising:

a PCV valve and a fresh air restriction cooperating to clear crankcase gases and maintain a crankcase vacuum in an idle state; and a PCV bypass and a relief valve cooperating to clear crankcase gases and limit a positive crankcase pressure in a boosted state.

5. The ventilation system of claim 4 further comprising:

a first vent line coupling the restriction and the relief valve to a fresh air inlet of the turbocharger; and a second vent line coupling the PCV valve and the PCV bypass to an intake manifold of the engine.

6. The ventilation system of claim 5 further comprising:

a pull separator in communication with the second vent line; and a push separator in communication with the first vent line;

wherein the PCV bypass is configured to bypass both the PCV valve and the pull separator.

7. The ventilation system of claim 4 wherein the PCV bypass is comprised of a check valve.

* * * * *